US008250791B2

(12) United States Patent
Gladman

(10) Patent No.: US 8,250,791 B2
(45) Date of Patent: Aug. 28, 2012

(54) VISUAL PRESENTATION CLIP ASSEMBLY

(76) Inventor: Jamie E. Gladman, Leawood, KS (US)

( * ) Notice: Subject to any disclaimer, the term of this patent is extended or adjusted under 35 U.S.C. 154(b) by 0 days.

(21) Appl. No.: 13/079,606

(22) Filed: Apr. 4, 2011

(65) Prior Publication Data

US 2011/0239502 A1 Oct. 6, 2011

Related U.S. Application Data

(60) Provisional application No. 61/320,506, filed on Apr. 2, 2010.

(51) Int. Cl.
*G09F 3/00* (2006.01)

(52) U.S. Cl. ..... 40/324; 40/666; 215/386

(58) Field of Classification Search ..... 40/324, 40/666; 215/386
See application file for complete search history.

(56) References Cited

U.S. PATENT DOCUMENTS 2,166,864 A * 7/1939 Gelardin ..... 40/555
2,296,005 A * 9/1942 Weiner ..... 40/555
3,316,396 A * 4/1967 Bulcroft et al. ..... 362/186
3,772,809 A * 11/1973 Schneller ..... 40/637
4,923,392 A * 5/1990 Moynihan, III ..... 431/253
5,317,490 A * 5/1994 Miller ..... 362/206
5,581,921 A * 12/1996 Hutchens ..... 40/324
6,206,688 B1 * 3/2001 Hunter ..... 431/126
6,332,285 B1 * 12/2001 Aaldenberg et al. ..... 40/641
D481,448 S * 10/2003 Argentina ..... D23/297
6,666,563 B2 * 12/2003 Brown ..... 362/84
6,851,825 B2 * 2/2005 Marshall ..... 362/142
7,259,655 B1 * 8/2007 Potts ..... 340/286.09
2009/0260486 A1 * 10/2009 Stowers ..... 81/3.09

* cited by examiner

*Primary Examiner* — Casandra Davis
(74) *Attorney, Agent, or Firm* — Law Office of Mark Brown, LLC; Mark E. Brown

(57) ABSTRACT

A visual notification device comprising a clip having a visual presentation may be attached to a food or drink container to indicate that a consumer who has temporarily left their seating or standing location, or food or drink container unattended, will return thereby avoiding the loss of a seating or standing location, or the disposal of unconsumed food or drink. The clip includes head with a front and rear face for displaying visual information such as text, an image, a logo, a trade name, an emblem, etc., an elongated body, a clip leg extending from the back of the clip behind the body, and a cap for connecting the assembly to a key ring or other attachment device.

10 Claims, 6 Drawing Sheets

VISUAL PRESENTATION CLIP ASSEMBLY

CROSS-REFERENCE TO RELATED APPLICATIONS

This application claims the benefit U.S. Provisional Patent Application No. 61/320,506 filed Apr. 2, 2010, which is incorporated herein by reference.

BACKGROUND OF THE INVENTION

1. Field of the Invention

The present disclosed technology relates generally to a clip for attaching to an item, and in particular to a reusable clip having a visual presentation for attaching to a food or drink container.

2. Description of the Related Art

Bars and restaurants are popular drinking and dining venues. Patrons often wait for available seating, and wish to hold their places during temporary absences.

What is needed is a device that can be attached to a food or drink container by a bar or restaurant customer to communicate to employees that they will return and to therefore not dispose of their food or drink containers. In addition, the device needs to communicate to other bar or restaurant customers that the seating or standing space in not available, and that they will return. Heretofore there has not been available a reusable clip having a visual presentation with the advantages and features of the disclosed subject matter.

SUMMARY OF THE INVENTION

A clip having a visual presentation may be attached to a food or drink container to indicate that a consumer who has temporarily left their seating or standing location, or food or drink container unattended, will return thereby avoiding the loss of a seating or standing location, or the disposal of unconsumed food or drink. The clip has a clip head with a front and rear face for displaying visual information such as text, an image, a logo, a trade name, an emblem, etc. The clip head is attached to an elongated body depending therefrom. An elongated back leg extends from the back of the clip behind the body. The clip is attached to a container by sliding the wall of a container having an exposed edge between the body and leg. A cap may releasably attach to the body of the clip and is adapted for connecting the assembly to a key ring or other attachment device. Alternatively, the clip may have an illumination circuit with a light emitting diode (LED) disposed within the clip head for illuminating the front and rear face, and associated visual information. A switch protruding from the front of the body is depressed when the cap is attached to the clip turning off the LED.

BRIEF DESCRIPTION OF THE DRAWINGS

The drawings constitute a part of this specification and include exemplary embodiments of the disclosed subject matter illustrating various objects and features thereof, wherein like references are generally numbered alike in the several views.

DETAILED DESCRIPTION OF THE PREFERRED EMBODIMENTS

I. Introduction And Environment

Figure 1:
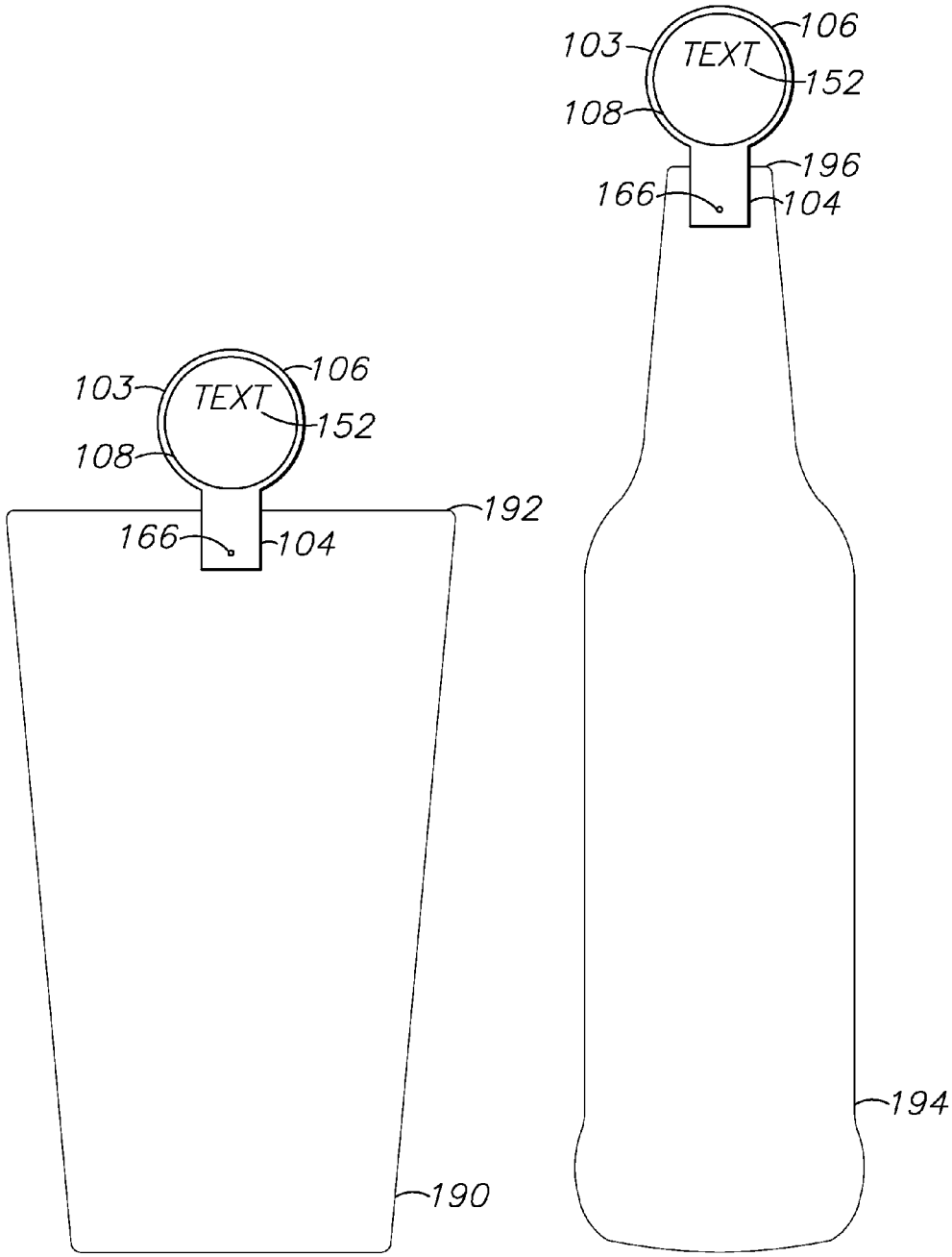
FIG. 1 is a front elevational view of the clip embodying the principles of the disclosed subject matter attached to a drink glass and a drink bottle.

As required, detailed aspects of the disclosed subject matter are disclosed herein; however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. Said terminology will include the words specifically mentioned, derivatives thereof and words of similar meaning.

II. Embodiment Or Aspect of the Visual Presentation Clip Assembly 102

Referring to the drawings in more detail, the reference numeral 102 generally designates a visual presentation clip assembly embodying the principles of the disclosed subject matter. The clip assembly 102 comprises a clip 103 separable from a cap 130. The clip assembly 102 is manufactured from a resilient material including, but not limited to: metal; plastic; acrylic; or cellulose material such as paper, cardboard or wood. The preferred embodiment is plastic.

Referring to FIG. 1, a clip 103 is shown attached over both the rim 192 of a drink glass 190, and the rim 196 of a drink bottle 194. The aforementioned drink containers are intended to be exemplary and are in no means meant to limit the scope of the invention. The clip 103 may be adapted for use with other types of containers or objects having a rim, or a wall with an exposed edge including, but not limited to, a food container or a tabletop display. The front face 108 may be used for the visual presentation of, for example, text 152 such as "Save My Seat," "This Seat is Taken," I'm Coming Back," or "Be Right Back" to communicate to a bar or restaurant customer or employee that the person consuming the drink in the container has temporarily left, and intends to return. The clip 103 thereby becomes an effective tool to avoid losing a standing or seating location, or disposal of unfinished food or drink.

Figure 2:
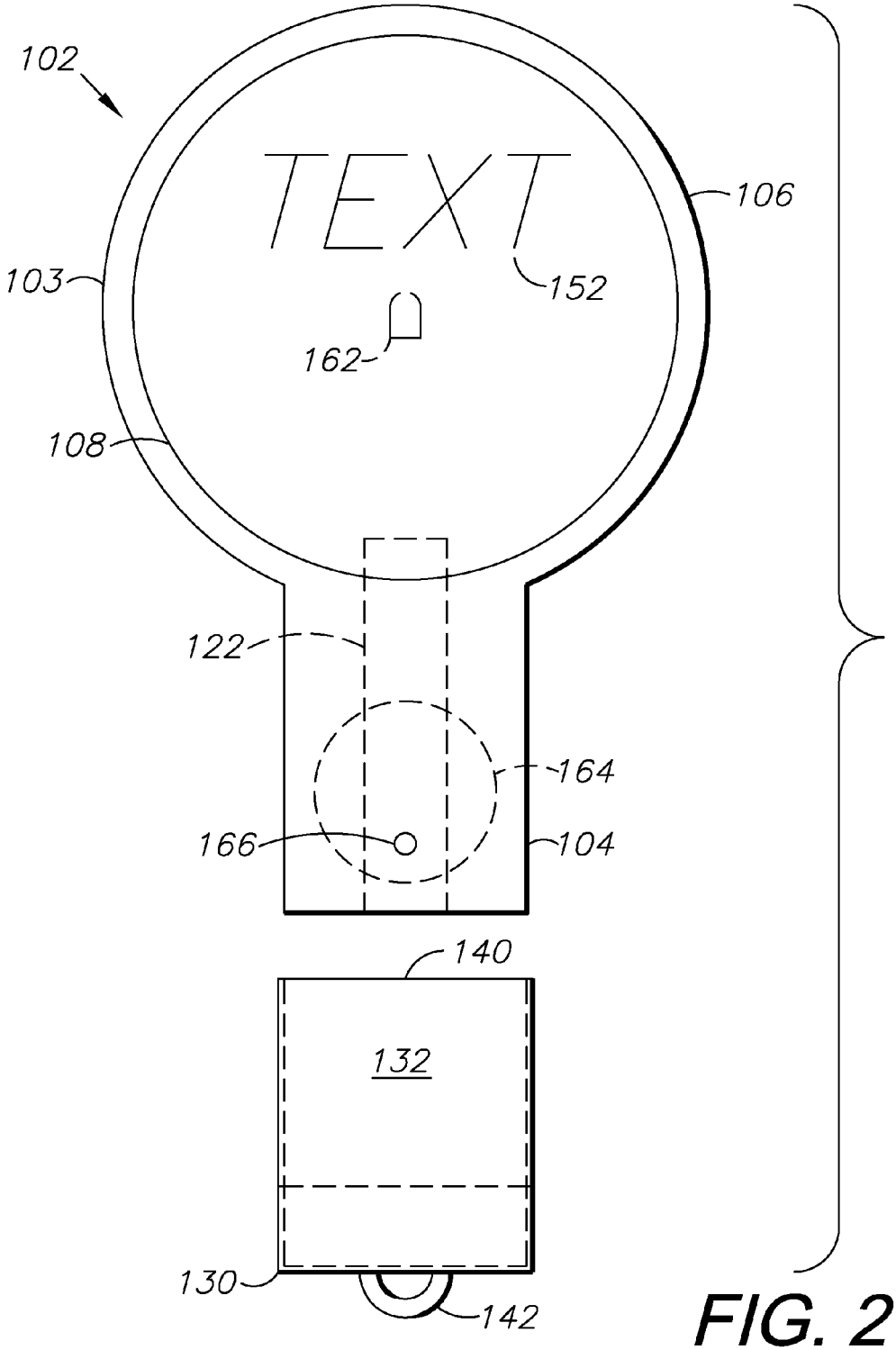
FIG. 2 is a front elevational view of the clip assembly.
Figure 3:
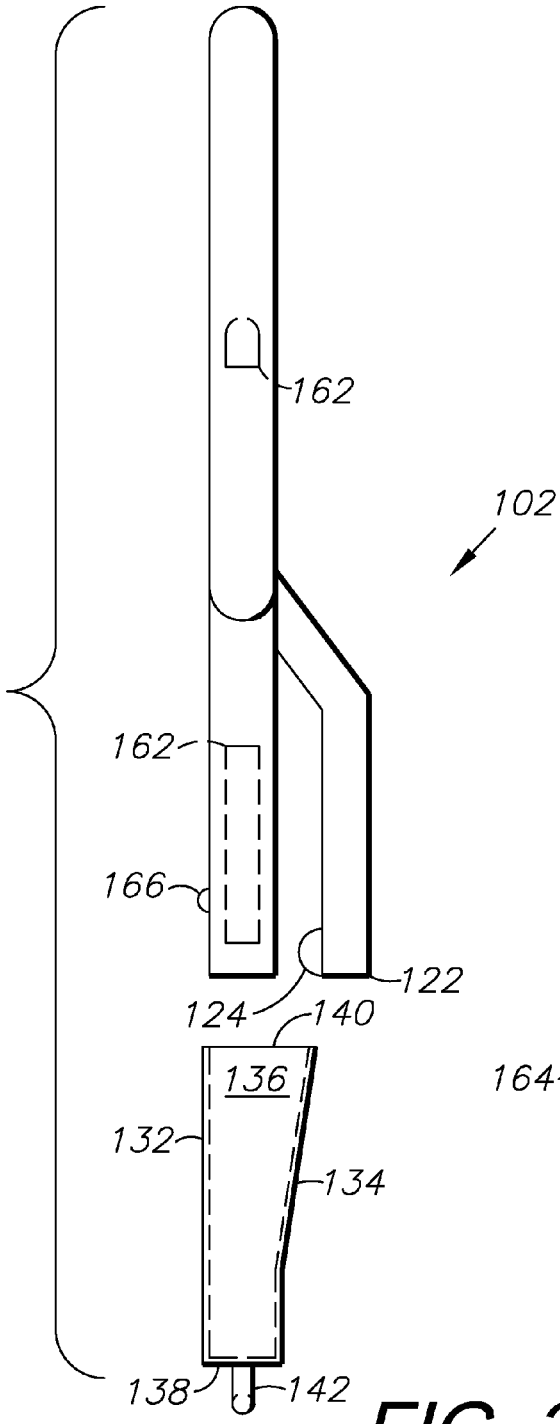
FIG. 3 is a side view of the clip assembly.
Figure 4:
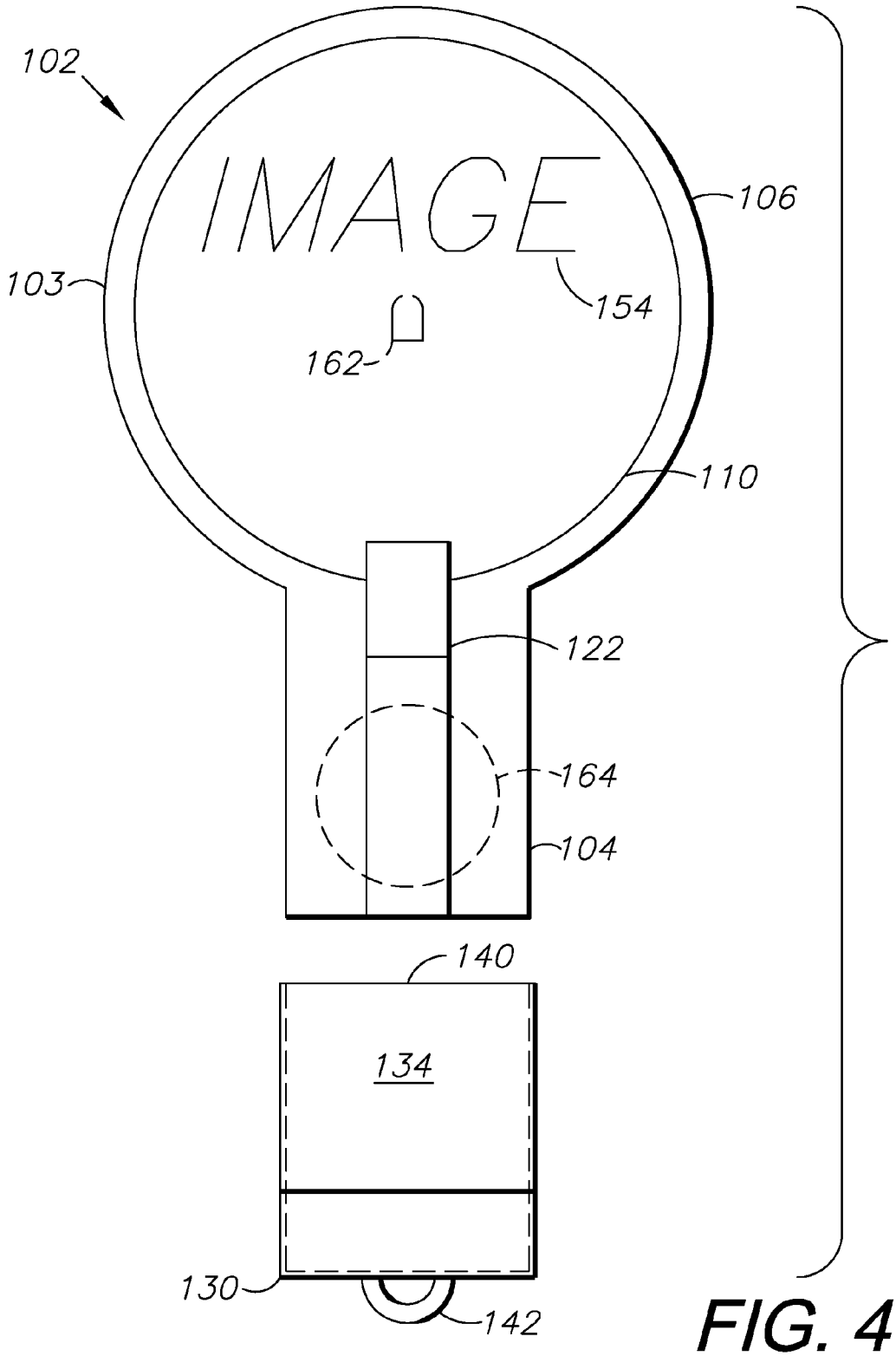
FIG. 4 is a back elevational view of the clip assembly.

Referring to FIGS. 2-4, the clip assembly 102 is shown with the clip 103 detached from a cap 130. The clip 103 comprises a clip head 106 having an elongated body 104 and an elongated back leg 122 depending therefrom. The preferred embodiment of the clip head 106 is circular as shown in FIGS. 1-4, however, the clip head 106 may comprise any other geometric shape, or non-geometric shape, as needed to suit a particular purpose. The front face 108 may be used to display text 152 as described above, or alternatively, may be used for any other type of visual presentation such as the display of an image, logo, trade name, emblem, etc. A back leg 122 extends rearward and downward from the back of the clip 103 terminating with a forward protruding bump 124. A space separates the clip body 104 and the back leg 122 allowing the clip 103 to be attached to an object having a wall and an exposed edge such as a drink glass 190 or drink bottle 194. The bump 124 enables the back leg 122 to deflect rearward slightly, and for the clip 103 to securely engage a container opening. The back face 110 is suitable for the visual presentation of information such as an image 154, or alternatively, may display text or other types of information such as described in conjunction with the front face 108.

A cap 130, dimensioned for releasable attachment to the clip body 104, comprises an upwardly open box having a top opening 140, opposite sidewalls 136, a front wall 132, an angular back wall 134, and a bottom wall 138. The back wall 134 extends rearward providing for easier alignment with the clip body 104, and for engaging the bump 124 to securely attach the cap 130 to the clip 103. A loop 142 depending from the bottom wall 138 is for receiving a key ring or other attachment device.

Figure 5:
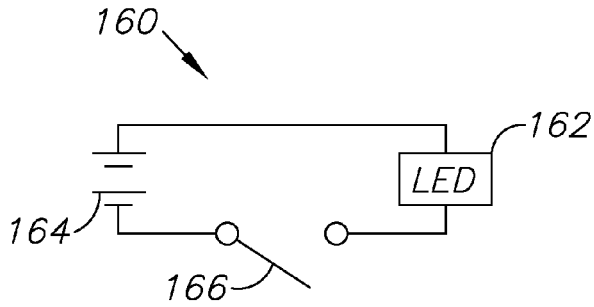
FIG. 5 is a schematic of the illumination circuit.

The clip 103 may be either illuminated or non-illuminated. The illuminated clip 103 includes an illumination circuit 160 (FIG. 5) for illuminating the clip head 106 with a light emitting diode (LED) 162. In such an application, the clip head 106 would be manufactured from a clear or translucent acrylic or plastic material. A battery 164 located in the clip 103 is connected to the LED 162 and a switch 166. The switch may protrude from the front of the clip body 104 and is depressed to turn off the LED 162 when the cap 130 is slid over the bottom of the clip body 104.

In use, the clip assembly 102 may be carried on a person. When it is time for the person to temporarily leave their seating or standing location, or their partially consumed food or beverage, the clip 103 is removed from the cap 130 and mounted on the rim 192, 196 of a respective drink glass 190 or drink bottle 194, or the exposed edge of a food container or tabletop display. Upon their return, the person removes the clip 103 from the container and reconnects it to the cap 130 for reuse.

The clip 103 may be used with or without a cap 130 for the visual presentation of information.

III. Alternative Embodiment 202

Figure 6:
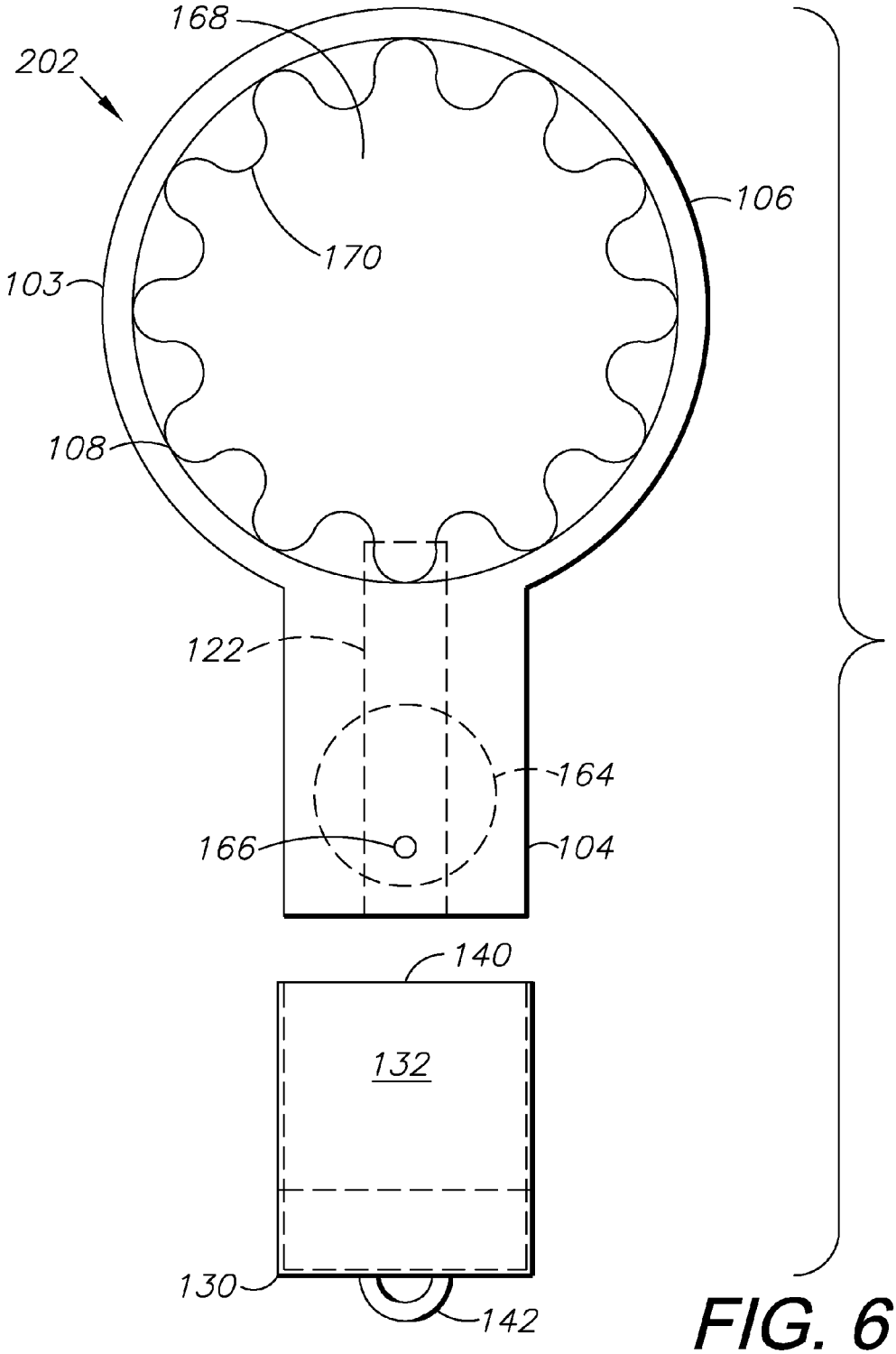
FIG. 6 is a back elevational view of an alternative embodiment clip assembly including a bottle-opener element.
Figure 7:
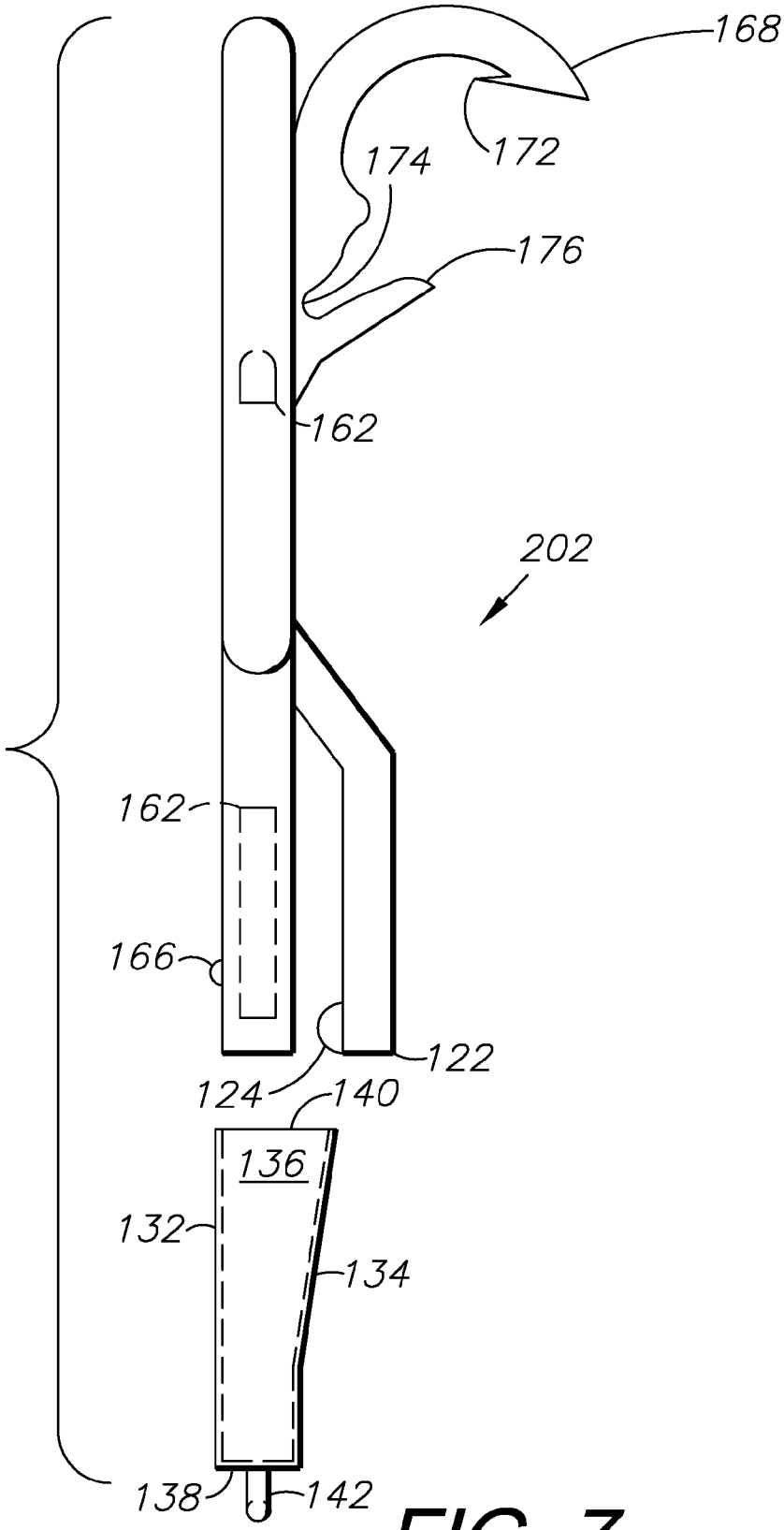
FIG. 7 is a side view of an alternative embodiment clip assembly including a bottle-opener element.

FIGS. 6 and 7 demonstrate alternative embodiment clips 202 featuring the addition of a common bottle opening device 168. Although a number of different mechanisms designed for opening bottles exist, only two examples are given herein. However, any feasible bottle opening device may be affixed to a face of said clip 202. The inclusion of a bottle opening device increases the functionality of the clip 202 and allows the user to carry one less item in his or her pocket at all times.

FIG. 6 demonstrates one example bottle opening device 168 which includes a number of ridges 170 corresponding to the ridges on a common bottle cap. The opening device 168 may be affixed to the front face 108 or the back face 110 of the clip 202.

FIG. 7 demonstrates a second example bottle opening device 168. This device includes a cap hook 172 for securing the opening device 168 to the bottle cap, a receiver gap 174 for receiving said bottle cap during the opening process, and a prying protrusion 176 used for physically removing a bottle cap from a bottle.

It will be appreciated that the components of the clip assembly 102 can be used for various other applications. Moreover, the components of the clip assembly 102 can be fabricated in various sizes and from a wide range of suitable materials, using various manufacturing and fabrication techniques.

It is to be understood that while certain aspects of the disclosed subject matter have been shown and described, the disclosed subject matter is not limited thereto and encompasses various other embodiments and aspects.

Having thus described the invention, what is claimed as new and desired to be secured by Letters Patent is:

1. A visual notification device adapted for attaching to an object's edge, the device comprising:

a body including a front face, a rear face, a top end, and a bottom end;

a notification device head including a front face and a rear face, said head affixed to said body top end;

a message or graphic indicia disposed upon said head;

a leg affixed to the back face of either said body or head;

said leg in an overlying relation to the back face of said head or body and adapted for receiving said object's edge;

a light emitting diode (LED) mounted to head and adapted for illuminating said head;

a battery located within said body for powering said LED;

a switch mounted to said body for controlling said LED;

a cap including a top end, a bottom end, and a loop affixed to said cap bottom end;

said cap top end adapted for temporarily receiving said body bottom end; and said cap loop adapted for connection with a key ring.

2. The visual notification device of claim 1, further comprising:

a bump generally located near the bottom edge of the front face of said body; and wherein said bump is adapted for engaging said cap with said body until sufficient force is applied to remove said cap from said body.

3. The visual notification device of claim 2, wherein:

the switch deactivates the LED while the cap is engaged with the body; and wherein the switch activates the LED when the cap becomes disengaged with the body.

4. The visual notification device of claim 1, wherein said object includes a drinking glass or glass bottle.

5. The visual notification device of claim 1, wherein the leg includes a bump adapted for deflecting the leg away from the body when said bump comes into contact with said object edge.

6. The visual notification device of claim 1, wherein the entire device is manufactured from a resilient material.

7. The visual notification device of claim 1, further comprising;

a bottle opening device affixed to said notification device head; and said bottle opening device being adapted for removing a cap from glass beverage bottles.

8. A visual notification device adapted for attaching to an object's edge, the device comprising:

a body, a head, a leg, and a cap manufactured from a resilient material;

said body including a front face, a rear face, a top end, a bottom end;

said head including a front face and a rear face, said head affixed to said body top end;

said head further adapted for displaying a message or a graphic;

said leg affixed to the back face of either said body or head;

said leg in an overlying relation to the back face of said head or body and adapted for receiving said object's edge;

said leg including a bump adapted for deflecting the leg away from the body when said bump comes into contact with said object edge;

said cap including a top end, a bottom end, and a loop affixed to said cap bottom end, wherein said cap top end is adapted for temporarily receiving said body bottom end;

said cap loop adapted for connection with a key ring;

a bump generally located near the bottom edge of the front face of said body adapted for engaging said cap with said body until sufficient force is applied to remove said cap from said body;

an LED within said head and adapted for illuminating said head;

a battery located within said body for powering said LED;

a switch mounted to said body for controlling said LED, said switch activating said LED when said cap is disengaged from said body, and said switch deactivating said LED when said cap is engaged with said body.

9. The visual notification device of claim 8 wherein said object includes a drinking glass or glass bottle.

10. A visual notification device adapted for attaching to an object's edge, the device comprising:

a body including a front face, a rear face, a top end, and a bottom end;

a notification device head including a front face and a rear face, said head affixed to said body top end;

a leg affixed to the back face of either said body or head;

said leg in an overlying relation to the back face of said head or body and adapted for receiving said object's edge;

a cap including a top end, a bottom end, and a loop affixed to said cap bottom end;

said cap top end adapted for temporarily receiving said body bottom end; and said cap loop adapted for connection with a key ring.

* * * * *